US005947082A

United States Patent [19]

Choi et al.

[11] Patent Number: 5,947,082

[45] Date of Patent: Sep. 7, 1999

[54] IDLE AIR BYPASS VALVE SILENCER

[75] Inventors: Michael Choi, Belleville; Mark Bruce Donielson, White Lake, both of Mich.

[73] Assignee: Ford Global Technologies, Inc., Dearborn, Mich.

[21] Appl. No.: 08/964,793

[22] Filed: Nov. 5, 1997

[51] Int. Cl.[6] ..... F02M 3/00

[52] U.S. Cl. ..... 123/339.1; 123/339.23; 181/253

[58] Field of Search ..... 123/339.1, 339.23, 123/184.21; 181/253, 229, 272

[56] References Cited

U.S. PATENT DOCUMENTS

| | | | |
|---|---|---|---|
| 3,810,526 | 5/1974 | Kawasaki . | |
| 3,835,956 | 9/1974 | Kishkira . | |
| 3,966,014 | 6/1976 | Gowing . | |
| 4,438,049 | 3/1984 | Ammons | 123/339.1 |
| 4,966,122 | 10/1990 | Frinzel | 123/339.1 |
| 5,042,448 | 8/1991 | Cook et al. . | |
| 5,097,656 | 3/1992 | Napier . | |
| 5,107,800 | 4/1992 | Araki et al. . | |
| 5,533,483 | 7/1996 | Gau et al. | 123/308 |
| 5,712,786 | 1/1998 | Ueda | 123/339.1 |

FOREIGN PATENT DOCUMENTS

| | | |
|---|---|---|
| 62-38872 | 2/1987 | Japan . |
| 4-66725 | 3/1992 | Japan . |
| 4-370324 | 12/1992 | Japan . |
| 5-156957 | 6/1993 | Japan . |

*Primary Examiner*—John Kwon
*Attorney, Agent, or Firm*—James J. Dottavio

[57] ABSTRACT

A silencer for an idle air bypass valve in an internal combustion engine includes a grid disposed between the outlet of the idle air bypass valve and the intake manifold. The grid acts to reduce the air velocity entering into the intake manifold which dampens the vibration of a plastic manifold, thereby reducing noise generated.

26 Claims, 2 Drawing Sheets

IDLE AIR BYPASS VALVE SILENCER

FIELD OF THE INVENTION

The present invention relates to an apparatus for an idle air bypass valve, and more particularly to an apparatus for reducing noise resulting from air flowing from the idle air bypass valve.

BACKGROUND OF THE INVENTION

Automotive engineers have increasingly utilized plastic materials in developing various engine components, including the intake manifold. Unlike prior aluminum manifolds, which have a high vibration dampening effect, plastic manifolds tend to vibrate more readily as high velocity air flows therethrough resulting in excessive noise.

To reduce such noise, prior art intake systems require elaborate silencing methods which, if incorporated into a modern internal combustion engine, require substantial packaging and/or redesign of the engine. The inventors of the present invention have found that a silencer connected between the outlet of the idle air bypass valve and the intake manifold is sufficient to reduce noise generation in the intake manifold. In addition, the apparatus may be incorporated onto existing engines, thereby allowing for field serviceability.

SUMMARY OF THE INVENTION

An object of the present invention is to provide an apparatus for reducing intake air noise.

This object is achieved, and disadvantages of prior art approaches overcome, by providing a novel idle air bypass valve silencer for an idle air bypass valve of an automotive internal combustion engine. The engine has an air intake duct, a throttle valve assembly coupled thereto and an intake manifold coupled to the throttle valve assembly and the engine. The idle air bypass valve has an inlet communicating with the air intake duct and an outlet communicating with the intake manifold to selectively bypass the throttle valve assembly. In one particular aspect of the invention, the silencer includes a housing and a silencer portion formed on the housing. The silencer portion is adapted to be coupled between the outlet of the bypass valve and the intake manifold. The silencer portion reduces air velocity flowing from the bypass valve into the intake manifold, thereby reducing noise generated therein.

An advantage of the present invention is that intake air noise is reduced, thereby reducing customer complaints.

Another advantage of the present invention is that a low cost apparatus which may be easily mounted to an existing engine is provided.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 1:
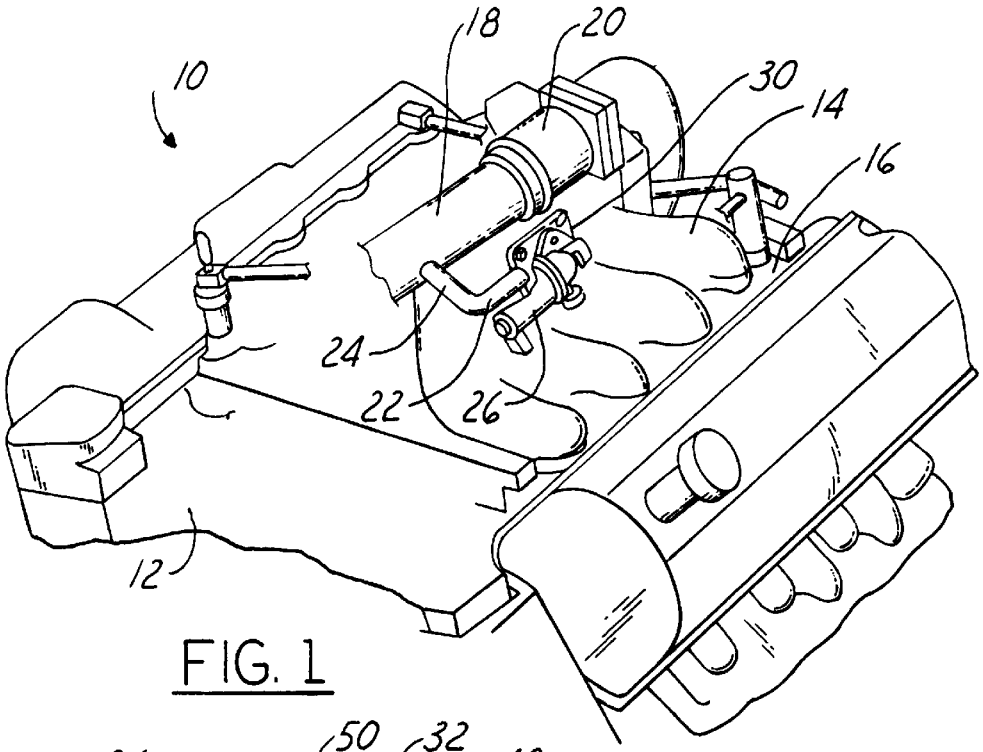
FIG. 1 is a diagrammatic representation of an engine incorporating the idle air bypass valve silencer according to the present invention.
Figure 2:
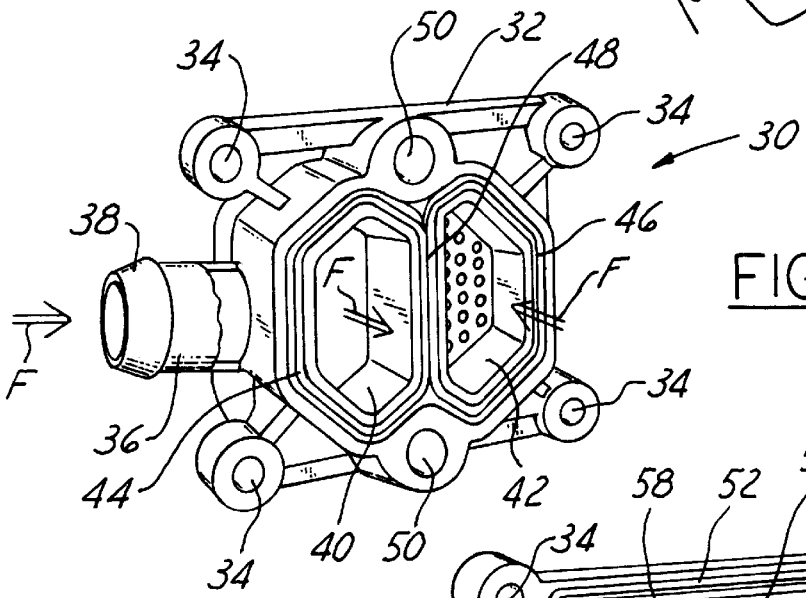
FIGS. 2 and 3 are perspective views of the idle air bypass valve silencer according to the present invention.
Figure 3:
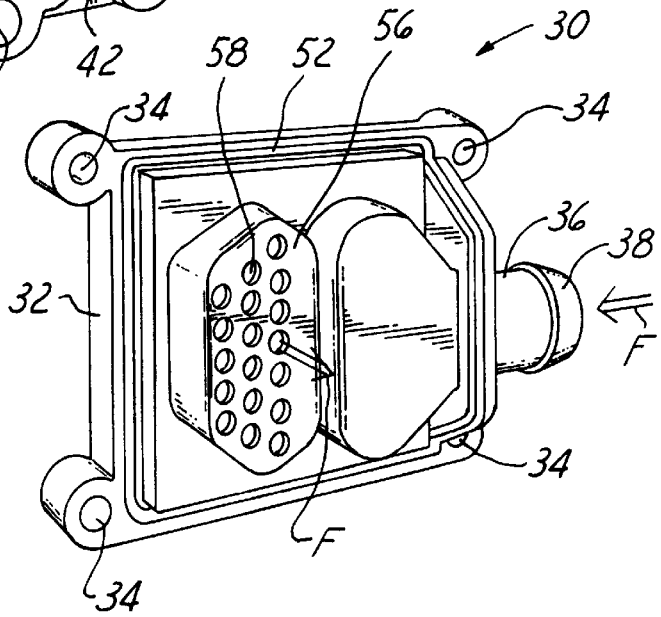

Automotive internal combustion engine 10, shown in FIG. 1, includes engine block 12, intake manifold 14 and cylinder head 16 mounted between engine block 12 and manifold 14. Air inlet duct 18 directs outside air to throttle valve assembly 20 into manifold 14. As is well known to those skilled in the art, air is metered by throttle valve assembly 20 such that the engine may operate at a speed proportional to the amount of air flowing past throttle valve assembly 20. Also, as is well known to those skilled in the art, when the engine is at idle, throttle valve assembly 20 is in a closed position. In order for air to be fed to the engine, idle bypass valve assembly 22 is included. Bypass valve assembly 22 includes intake hose 24 connected to solenoid valve 26. At engine idle, valve 26 opens to allow air to flow from port 24 through solenoid valve 26 directly into manifold 14, thereby bypassing throttle valve assembly 20. The amount of air flowing through bypass valve assembly 22 corresponds to the desired engine speed at engine idle. According to the present invention, to reduce noise associated with the use of plastic manifolds, a portion of silencer 30 is disposed between the outlet of valve 26 and manifold 14, as will be readily appreciated hereinafter.

A more detailed description of silencer 30 will now be described with reference to FIGS. 2–6. Silencer 30 includes a generally rectangular housing 32 formed of a plastic material. Mounting holes 34 are conveniently located around the perimeter of housing 32 to mount silencer 30 to manifold 14. Silencer further includes inlet tube 36 formed at one end thereof for receiving air from tube 24 (see FIG. 1). Inlet 36 further includes rib 38, which effectively prevents tube 24 from dislodging therefrom. Silencer 30 further includes generally trapezoidal shaped air chambers 40 and 42. Chamber 40 is disposed between inlet 36 and the inlet to bypass valve 26, whereas chamber 42 is disposed between the outlet of bypass valve 26 and intake manifold 14. Thus, with the operation of idle bypass valve 26, air is able to flow (as shown by flow arrow F) from inlet 36 through chamber 40, and into chamber 42. Seals 44 and 46 surround chambers 40 and 42, respectively, to sealingly engage silencer 30 to solenoid valve 26. In the embodiment described herein, seals 44 and 46 are joined at interface 48. Mounting holes 50 are formed in housing 32 to receive solenoid valve 26. Silencer 30 further includes seal 52 formed around the periphery of housing 32 so that silencer 30 may be sealingly engaged to intake manifold 14.

Figure 4:
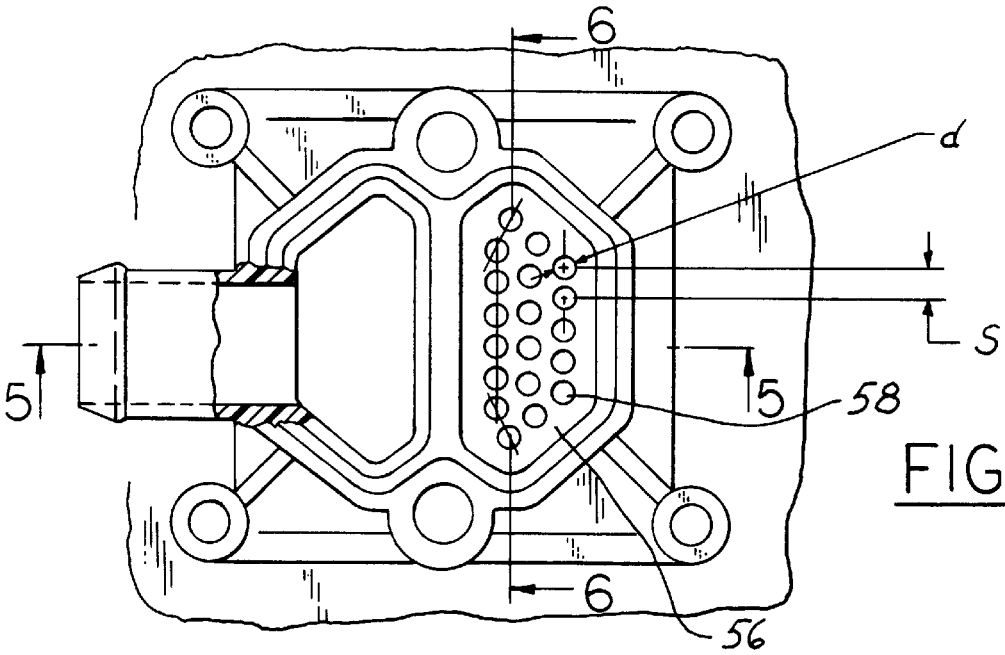
FIG. 4 is a plan view of the silencer according to the present invention.
Figure 5:
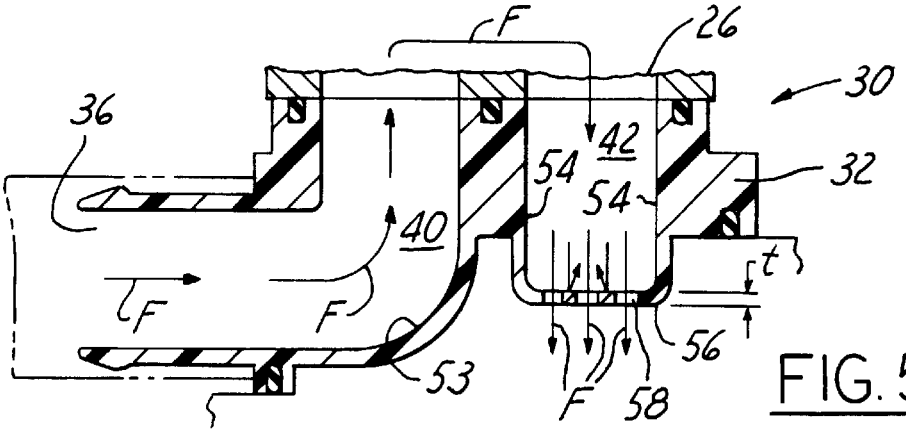
FIG. 5 is a cross-sectional view taken along line 5—5 of FIG. 4; and, FIG. 6 is a cross-sectional view taken along line 6—6 of FIG. 4.
Figure 6:
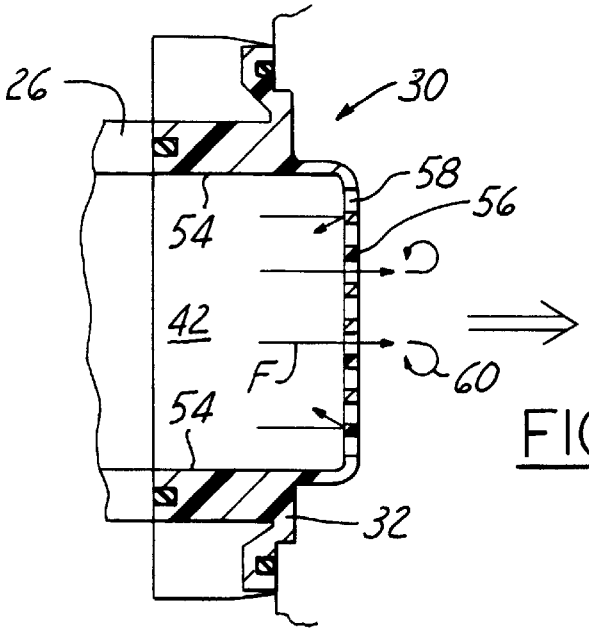

Referring now specifically to FIGS. 4–6, silencer 30 includes radius 53 formed between chamber 40 and inlet 36 to smoothly direct the air flow. This reduces air turbulence and results in noise reduction as air flows through silencer 30.

Continuing with reference to FIGS. 4–6, chamber 42 includes walls 54 and grid plate 56. In a preferred embodiment, the thickness (t) of grid plate 56 is about 7 mm. The volume of chamber 42 defined by walls 54 and grid plate 56 is sufficient to reduce the velocity of air exiting valve 26 to a predetermined velocity. In addition, Grid plate 56 includes a plurality of equally spaced holes 58 thereby forming a grid, to allow air to flow from chamber 42 to manifold 14. In a preferred embodiment, the diameter (d) of a hole is about 3 mm, and the center-to-center spacing (s) between holes is about 1.5 mm. Thus, a hole diameter (d) to thickness (t) ratio of about 3:7 is preferable.

As shown in FIG. 5, air flows from inlet 36 through valve 26 into chamber 42 and out through holes 58. As the air strikes grid plate 58, a portion of the air is reflected back into chamber 42, which ultimately reduces the air velocity flowing out through holes 58. Further, as specifically shown in FIG. 6, air flowing through holes 58 on grid plate 56 creates a turbulent flow 60 which tends to cancel each other due to the equal spacing (s), described above. This cancellation further reduces noise as air flows from silencer 30.

While the best mode for carrying out the invention has been described in detail, those skilled in the art to which this invention relates will recognize various alternative designs and embodiments, including those mentioned above, in practicing the invention that has been defined by the following claims.

We claim:

1. A silencer for an idle air bypass valve of an automotive internal combustion engine, the engine having an air intake duct, a throttle valve assembly coupled thereto and an intake manifold coupled to the throttle valve assembly and the engine, with the idle air bypass valve having an inlet communicating with the air intake duct and an outlet communicating with the intake manifold to selectively bypass the throttle valve assembly, with the silencer comprising:

a housing; and, a silencer portion formed on said housing, with said silencer portion having a restriction means and being adapted to be coupled between the outlet of the bypass valve and the intake manifold, with said restriction means reducing air velocity flowing from the bypass valve into the intake manifold, thereby reducing noise generated therein.

2. A silencer according to claim 1 wherein said restriction means comprises a grid plate having a plurality of holes formed therein, with said grid plate restricting velocity of air flowing therethrough.

3. A silencer according to claim 2 wherein each said hole has a diameter of about 3 mm.

4. A silencer according to claim 2 wherein said grid plate has a thickness of about 7 mm.

5. A silencer according to claim 1 wherein a center to center spacing of said holes is about 1.5 mm.

6. A silencer according to claim 2 further comprising a chamber disposed upstream of said grid plate, with said chamber having a predetermined volume for reducing air velocity flowing from the outlet of the bypass valve.

7. A silencer according to claim 1 further comprising an inlet portion formed on said housing, with said inlet portion being adapted to be coupled between the air intake duct and the inlet of the bypass valve.

8. A silencer for an idle air bypass valve of an automotive internal combustion engine, the engine having an air intake duct, a throttle valve assembly coupled thereto and an intake manifold coupled to the throttle valve assembly and the engine, with the idle air bypass valve having an inlet communicating with the air intake duct and an outlet communicating with the intake manifold to selectively bypass the throttle valve assembly, with the silencer comprising:

a housing adapted to be mounted to the bypass valve and the intake manifold;

an inlet tube formed on said housing, with said inlet tube being adapted to be coupled to the air intake duct;

an inlet chamber formed in said housing and communicating with said inlet tube, with said inlet chamber being adapted to be coupled to the inlet of the bypass valve;

an outlet chamber formed in said housing adjacent said inlet chamber, with said outlet chamber being adapted to be coupled to the outlet of the bypass valve and the intake manifold;

a grid plate formed at a downstream end of said outlet chamber, thereby partially enclosing said outlet chamber, with said grid plate comprising a plurality of holes formed therein, with said grid plate restricting velocity of air flowing therethrough, thereby reducing noise generated in the intake manifold.

9. A silencer according to claim 8 wherein each said hole has a diameter of about 3 mm.

10. A silencer according to claim 8 wherein said grid plate has a thickness of about 7 mm.

11. A silencer according to claim 8 wherein a center to center spacing of said holes is about 1.5 mm.

12. A silencer according to claim 8 wherein said outlet chamber and said grid plate define a predetermined volume of space for reducing air velocity flowing from the outlet of the bypass valve.

13. A silencer according to claim 8 further comprising a seal disposed between said inlet chamber and the inlet to the bypass valve to limit air leakage from therebetween.

14. A silencer according to claim 8 further comprising a seal disposed between said outlet chamber and the outlet from the bypass valve to limit air leakage from therebetween.

15. A silencer according to claim 8 further comprising a seal disposed between said outlet chamber downstream from said grid plate and the intake manifold to limit air leakage from therebetween.

16. An idle air bypass assembly for an automotive internal combustion engine, the engine having an air intake duct, a throttle valve assembly coupled thereto and an intake manifold coupled to the throttle valve assembly and the engine, with the idle air bypass assembly comprising:

a solenoid actuated idle air bypass valve having an inlet and an outlet, with said inlet adapted to communicate with the air intake duct and with said outlet adapted to communicate with the intake manifold to bypass the throttle valve assembly;

a silencer housing coupled to said idle air bypass valve and adapted to be mounted to the intake manifold, with said silencer housing comprising:

an inlet tube formed on said housing, with said inlet tube being adapted to be coupled to the air intake duct;

an inlet chamber formed in said housing and communicating with said inlet tube, with said inlet chamber being coupled to the inlet of the bypass valve;

an outlet chamber formed in said housing adjacent said inlet chamber, with said outlet chamber being coupled to the outlet of the bypass valve;

a grid plate formed at a downstream end of said outlet chamber, thereby partially enclosing said outlet chamber, with said grid plate comprising a plurality of holes formed therein, with said grid plate restricting velocity of air flowing therethrough, thereby reducing noise generated in the intake manifold.

17. An idle air bypass assembly according to claim 16 wherein each said hole has a diameter of about 3 mm.

18. An idle air bypass assembly according to claim 16 wherein said grid plate has a thickness of about 7 mm.

19. A silencer according to claim 16 wherein a center to center spacing of said holes is about 1.5 mm.

20. An idle air bypass assembly according to claim 16 wherein said outlet chamber and said grid plate define a predetermined volume of space for reducing air velocity flowing from the outlet of the bypass valve.

21. A silencer for an idle air bypass valve of an automotive internal combustion engine, the engine having an air intake duct, a throttle valve assembly coupled thereto and an intake manifold coupled to the throttle valve assembly and the engine, with the idle air bypass valve having an inlet communicating with the air intake duct and an outlet communicating with the intake manifold to selectively bypass the throttle valve assembly, with the silencer comprising:

a housing; and, a silencer portion formed on said housing, with said silencer portion being adapted to be positioned abutting the bypass valve between the air intake duct and the intake manifold, said silencer portion comprising a grid plate having a plurality of holes formed therein, with said grid plate restricting velocity of air flowing therethrough to reduce air velocity flowing into the intake manifold, thereby reducing noise generated therein.

22. A silencer according to claim 21 wherein each said hole has a diameter of about 3 mm.

23. A silencer according to claim 21 wherein said grid plate has a thickness of about 7 mm.

24. A silencer according to claim 21 wherein a center to center spacing of said holes is about 1.5 mm.

25. A silencer according to claim 21 further comprising a chamber disposed upstream of said grid plate, with said chamber having a predetermined volume sufficient to reduce air velocity flowing from the outlet of the bypass valve.

26. A silencer according to claim 21 further comprising an inlet portion formed on said housing, with said inlet portion being adapted to be coupled between the air intake duct and the inlet of the bypass valve.

* * * * *